US008439709B2

(12) United States Patent
Fan

(10) Patent No.: US 8,439,709 B2
(45) Date of Patent: May 14, 2013

(54) SOCKET WITH IMPROVED CONTACT ARRAY

(75) Inventor: Chia-Wei Fan, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 71 days.

(21) Appl. No.: 13/227,496

(22) Filed: Sep. 8, 2011

(65) Prior Publication Data

US 2012/0064774 A1 Mar. 15, 2012

(51) Int. Cl.
*H01R 24/00* (2006.01)

(52) U.S. Cl.
USPC ..... 439/660

(58) Field of Classification Search ..... 439/660, 439/626, 862, 83, 607.1
See application file for complete search history.

(56) References Cited

U.S. PATENT DOCUMENTS 5,746,608 A * 5/1998 Taylor ..... 439/70
6,241,535 B1 * 6/2001 Lemke et al. ..... 439/83
6,325,644 B1 * 12/2001 Lemke et al. ..... 439/83
6,688,893 B1 * 2/2004 Huang et al. ..... 439/66
6,758,702 B2 * 7/2004 Johnescu ..... 439/862
7,156,706 B2 * 1/2007 Brown et al. ..... 439/862
7,160,115 B2 * 1/2007 Huang et al. ..... 439/66
7,802,999 B2 * 9/2010 Lemke et al. ..... 439/83
8,047,874 B2 * 11/2011 Ito ..... 439/607.1
8,079,851 B1 * 12/2011 Ma ..... 439/83
2010/0216344 A1 * 8/2010 Fan ..... 439/626

FOREIGN PATENT DOCUMENTS

TW M364310 U 9/2009

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector, adapted for electrically connecting an integrated circuit package, comprises a plurality of contacts, a plurality of solder balls disposed on tails of the contacts and an insulative housing. The insulative housing defines a plurality of passageways receiving the contacts. Each contact has a retaining portion, an elastic arm and a soldering portion. The contacts positioned in two adjacent rows of passageways are arranged staggered in a back to back manner. Such arrangement of the contacts of the electrical connector allows much more contacts to be put in the insulative housing.

19 Claims, 3 Drawing Sheets

SOCKET WITH IMPROVED CONTACT ARRAY

BACKGROUND OF THE INVENTION

1. Field of the Invention

The present invention relates to a socket, especially to a socket adapted for electrically connecting an IC (integrated Circuit) package to a printed circuit board.

2. Description of the Related Art

To electrically connect to a printed circuit board, an IC (integrated Circuit) package usually need a socket disposed between the IC package and the printed circuit board and electrically connecting with the IC package and the printed circuit board, respectively, for transferring signals between the IC package and the printed circuit board.

A BGA (Ball Grid Array) socket is most popular in those sockets, U.S. Pat. No. 6,688,893 discloses such a socket, which usually comprises an insulative housing and a plurality of contacts received in the insulative housing. The insulative housing has a first surface and a second surface and defines a plurality of receiving cavities passing through the first and the second surfaces, and each receiving cavity receives two opposite disposed contacts. The contact is formed with a retaining portion retained to the insulative housing, a soldering portion extending from an end of the retaining portion, a bending portion extending from another end of the retaining portion away from the soldering portion and an elastic arm extending from the bending portion. The manner of putting two contacts in a same receiving cavity can reduce a pitch between adjacent contacts to improve contact density of the socket. However, there is a risk of short circuit between the two contacts, so the receiving cavity of the insulative housing must be designed with a complex configuration.

Hence, an improved socket is required to overcome the disadvantages of the prior art.

SUMMARY OF THE INVENTION

An object of the invention is to provide a socket, which has a improved contact array to provide a high contact density.

To achieve the above-mentioned object, a socket, adapted for electrically connecting an IC (integrated Circuit) package and a printed circuit board, comprises an insulative housing and a plurality of contacts. The insulative housing defines a plurality of separated contact passageways arranged in lines. The contacts comprises a plurality of first contacts retained to in lines of the contact passageways and a plurality of second contacts retained to the contact passageways in different lines of the contact passageways, each contact passageway receives only one contact. The first contact and the second contact received in two adjacent lines of contact passageways are set in a manner of back to back, and the first contact has a different configuration with the second contact.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiments of the present invention.

Figure 1:
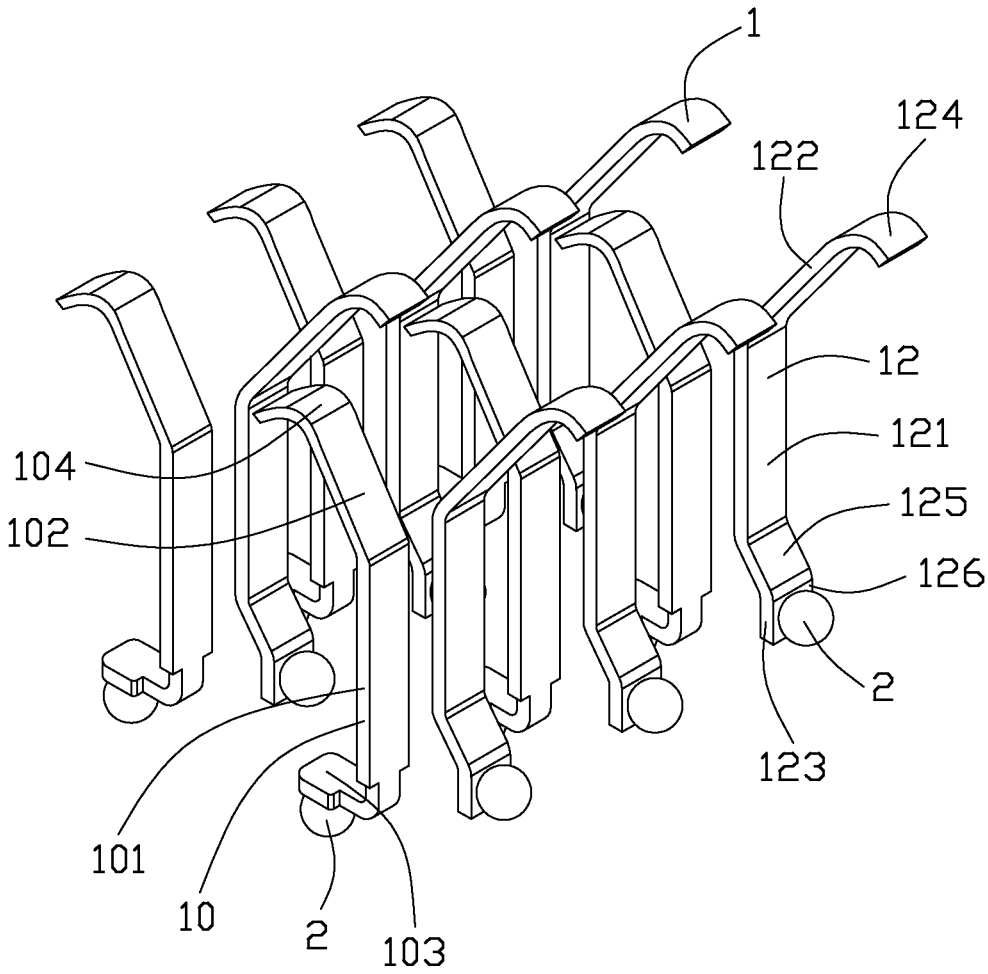
FIG. 1 is a perspective view of contacts of a socket in accordance with a preferred embodiment of present invention, wherein the contacts are arranged in lines and attached with solder balls.
Figure 2:
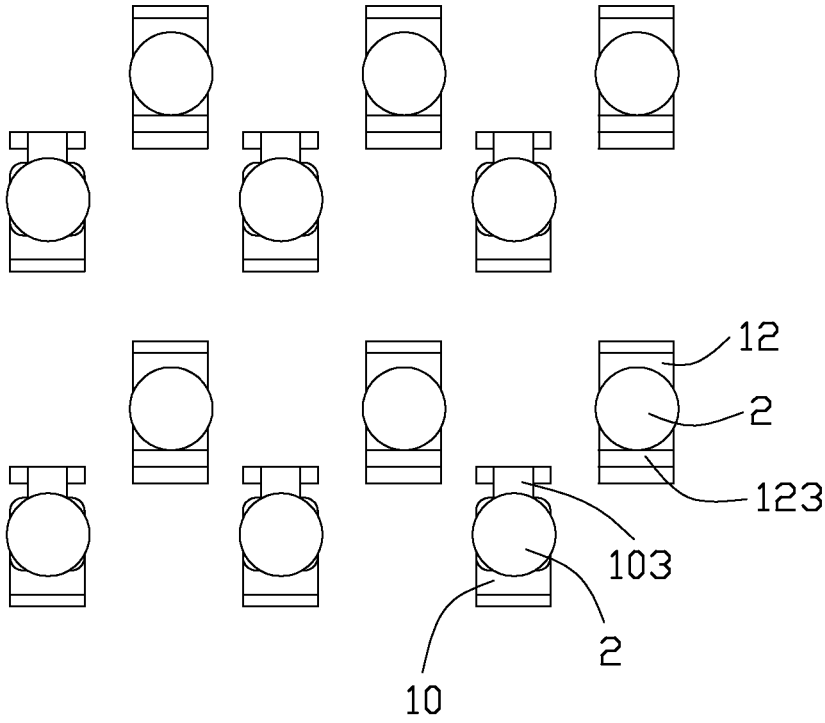
FIG. 2 is bottom view of the contacts with solder balls in FIG. 1.
Figure 3:
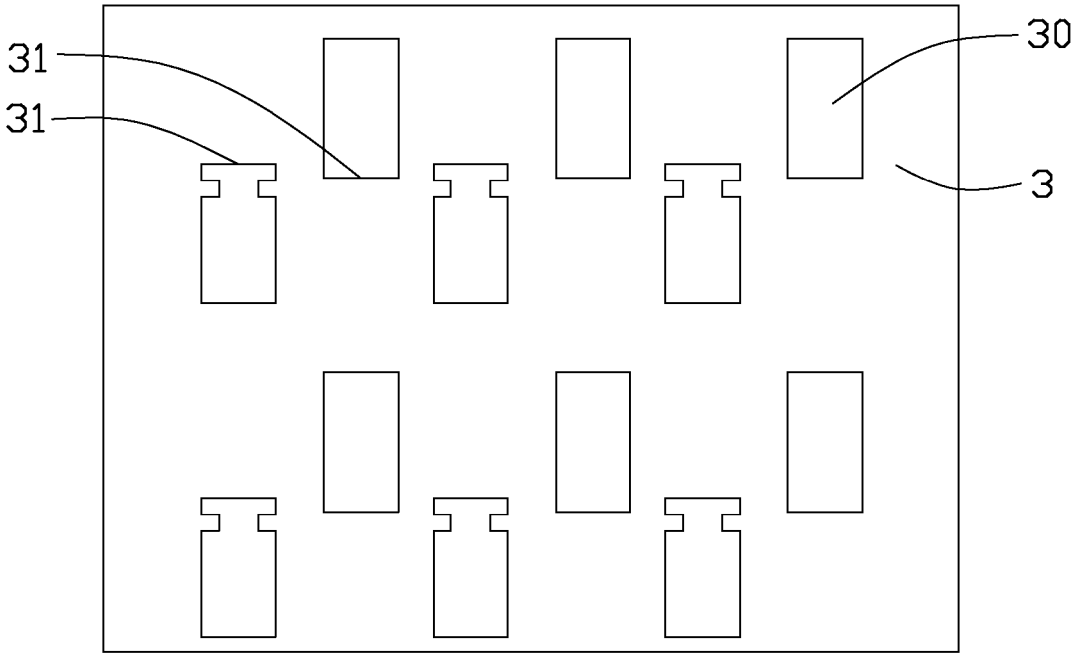
FIG. 3 is a perspective view of an insulative housing of the socket for receiving the contacts, in accordance with the preferred embodiment of present invention.

Referring to FIGS. 1-3, a socket in accordance with a preferred embodiment of present invention is adapted for electrically connecting an IC (integrated Circuit) package to a printed circuit board (not shown). The socket 1 comprises a plurality of contacts 1, a plurality of solder balls 2 attached to the contacts 1 and an insulative housing 3.

The contacts 1 are stamped from metal pieces and include a plurality of first contacts 10 and a plurality of second contacts 12, and the first and the second contacts 10, 12 are arrayed in lines respectively. The first contact 10 has a first retaining portion 101 to retain the first contact 10 to the insulative housing 3, a first elastic arm 102 extending upwardly from the first retaining portion 101 and a first soldering portion 103 disposed below the first retaining portion 101. The second contact 12 has a second retaining portion 121 to retain the second contact 12 to the insulative housing 3, a second elastic arm 122 extending upwardly from the second retaining portion 121 and a second soldering portion 123 disposed below the second retaining portion 121.

Both of the first elastic arm 102 and the second elastic arm 122 have an arch contacting portion 104, 124 at an top end thereof, respectively. The first soldering portion 103 and the first elastic arm 102 are located on a same side of the first retaining portion 101, and the second soldering 123 and the second elastic arm 122 are located on a same side of the second retaining portion 121. However, the first and the second soldering portions 103, 123 have different configurations, the first soldering portion 103 of the first contact 10 is a horizontally extending piece, the solder ball 2 is attached to a bottom surface of the first soldering portion 103; and the second soldering portion 123 has an inclined portion 125 downwardly slopping from the second retaining portion 121 and an upright portion 126 downwardly extending from the inclined portion 125, the solder ball 2 is attached to an outside surface of the upright portion 126.

The insulative housing 3 defines a plurality of separated contact passageways 30 for receiving the contacts 1. The contact passageways 30 are arrayed in lines, and the contact passageways 30 in adjacent lines are staggered and two near lines of contact passageways 30 belongs to one group. A distance between two adjacent lines of contact passageways 30 in two adjacent groups is bigger than a distance between two lines of contact passageways 30 within a same one group. Two lines of adjacent inner sidewalls 31 of the two lines of passageways 30 in the same one group close each other so as to improve a density of the contact passageways 30 and the density of the contacts 1.

When assembly, the first contacts 10 are assembled into one line of each group of contact passageways 30, the second contacts 12 are assembled into another line of each group of contact passageways 30, the first contacts 10 and the second contacts 12 are staggered in adjacent lines. In present preferred embodiment, the first contacts 10 and the second contacts 12 received in one group of contact passageways 30 are set by a back to back manner, in another words, the first retaining portions 101 of the first contacts 10 and the second retaining portions 121 of the second contacts 12 abut the adjacent inner sidewalls 31, respectively, and are substantially positioned in a beeline, and the first and the second elastic arm 102, 122 extend toward two opposite directions, respectively, and the first and the second soldering portions 103, 123 extend toward two the opposite directions, respectively.

Since the first soldering portion 103 and the second soldering portion 123 have different configurations, the inclined portion 125 brings the upright portion 126 of the second soldering portion 123 away from an adjacent first soldering portion 103 so as to prevent a short circuit with the adjacent first soldering portion 103. Furthermore, the solder ball 2 is disposed on the outside surface of the upright portion 126, and the upright portion 126 can limit a backwardly flowing of the solder ball 2 in melting to prevent short circuit.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket, adapted for electrically connecting an IC (integrated Circuit) package and a printed circuit board, comprising:

an insulative housing defining a plurality of separated contact passageways arranged in lines; and a plurality of contacts, the contacts comprising a plurality of first contacts retained to in lines of the contact passageways and a plurality of second contacts retained to the contact passageways in different lines of the contact passageways, each contact passageway receiving only one contact, and each first contact and each second contact received in two adjacent lines of contact passageways set in a manner of back to back, and the first contact having a different configuration with the second contact.

2. The socket as described in claim 1, wherein each first contact has a first retaining portion to retain the first contact to the insulative housing, a first elastic arm extending upwardly from the first retaining portion and a first soldering portion disposed below the first retaining portion; and each second contact has a second retaining portion to retain the second contact to the insulative housing, a second elastic arm extending upwardly from the second retaining portion and a second soldering portion disposed below the second retaining portion, the plurality of first contacts and the plurality of second contacts in the two adjacent lines are staggered.

3. The socket as described in claim 2, wherein the first soldering portion of each first contact is a horizontally piece, and the second soldering portion of each second contact has an upright portion at a free end thereof.

4. The socket as described in claim 3, wherein the second soldering portion has an inclined portion downwardly slopping from the second retaining portion, and the upright portion downwardly extends from the inclined portion.

5. The socket as described in claim 2, wherein a solder ball is attached to a bottom surface of the first soldering portion, and another solder ball is attached to a outside surface of the upright portion.

6. The socket as described in claim 3, wherein the first elastic arm and the second elastic arm extend toward two opposite directions, respectively, and the first elastic arm and the first soldering portion are located on a same side of the first retaining portion, and the second elastic arm and the second soldering portion are located on a same side of the second retaining portion.

7. The socket as described in claim 2, wherein the first retaining portions and the second retaining portions of each first contact and each second contact in the two adjacent lines are substantially positioned in a beeline.

8. The socket as described in claim 7, wherein the separated contact passageways has several groups, each group comprises two lines of contact passageways for receiving each first and each second contact respectively, a distance between two adjacent lines of contact passageways in two adjacent groups is bigger than a distance between two lines of contact passageways within a same one group.

9. A socket comprising:

an insulative housing defining a plurality lines of separated contact passageways, and two adjacent lines of the contact passageways being staggered; and a plurality of contacts, the contacts comprising a plurality of first contacts and a plurality of second contacts, the plurality of first contacts and the plurality of second contacts received in the contact passageways in lines, respectively, each first contact having a first retaining portion to retain the first contact, a first elastic arm extending upwardly from the first retaining portion and a first soldering portion horizontally extending from the retaining portion; each second contact has a second retaining portion to retain the second contact, a second elastic arm extending upwardly from the second retaining portion and a second soldering portion extending from the second retaining portion, and the first and second contacts received the two adjacent lines of contact passageways set in a manner of back to back.

10. The socket as described in claim 9, wherein the second soldering portion has an inclined portion downwardly slopping from the second retaining portion, and an upright portion downwardly extending from the inclined portion.

11. The socket as described in claim 10, wherein a solder ball is attached to a bottom surface of the first soldering portion, another solder ball is attached to a outside surface of the upright portion.

12. The socket as described in claim 10, wherein each contact passageways has several groups, each group comprises two adjacent lines of contact passageways for receiving the plurality of first and the plurality of second contacts respectively, a distance between two adjacent lines of contact passageways in two adjacent groups is bigger than a distance between two lines of contact passageways within a same one group.

13. The socket as described in claim 12, wherein two adjacent contact passageways in two lines within a same one group overlap with each other.

14. The socket as described in claim 12, wherein the two adjacent lines of contact passageways in two adjacent groups are isolated with each other along a direction vertical to an extending direction of the line of the contact passageways.

15. An electrical connector comprising:

a plurality of passageways defined in an insulative socket in rows and columns intersecting with each other under condition that the neighboring passageways are alternately offset from one another in both column and row directions so that in a top view, each passageway has corresponding closer neighboring passageways in a diagonal direction rather than in either the row direction or the column direction;

said rows categorized with odd numbers and even numbers alternately arranged with each other along the column direction;

a plurality of first contacts disposed in the corresponding passageways in the rows of the odd numbers;

a plurality of second contacts disposed in the corresponding passageways in the rows of the even numbers;

each of the passageways in the rows of the odd number defining a first retention region to receive a first vertical retention plate of the corresponding first contact;

each of the passageways in the rows of the even number defining a second retention region to receive a second vertical retention plate of the corresponding second contact; wherein in the passageways of every paired neighboring rows of the odd number and the even number, the first retention regions and the second retention regions are close to an imaginary interface line of the passageways of the paired neighboring rows of the odd number and the even number in a zigzag manner so as to allow the corresponding first contacts and second contacts to be alternately arranged in a same contact carrier strip for simultaneous insertion into the corresponding passageways of the paired neighboring rows of the odd number and the even number under condition that the first vertical retention plates and the second vertical retention plates are aligned with each other along the row direction.

16. The electrical connector as claimed in claim 15, wherein the corresponding passageways of the paired neighboring rows of the odd number and the even number define overlapped portions around said imaginary interface line in the row direction.

17. The electrical connector as claimed in claim 15, wherein the plurality of first contacts and the plurality of second contacts are configured different from each other.

18. The electrical connector as claimed in claim 15, wherein an internal distance between the passageways of every paired neighboring rows of the odd number and the even number in the column direction is smaller than an external distance between the passageways of the neighboring paired neighboring rows of the odds number and the even numbers in the column direction.

19. The electrical connector as claimed in claim 15, wherein both the plurality of first contacts and the plurality of second contacts are equipped with corresponding solder balls but in different ways.

* * * * *